US010611508B2

(12) United States Patent
Wang

(10) Patent No.: US 10,611,508 B2
(45) Date of Patent: Apr. 7, 2020

(54) SLEEVE LABELING MACHINE

(71) Applicant: ALLEN PLASTIC INDUSTRIES CO., LTD., Kaohsiung (TW)

(72) Inventor: Kenneth Wang, Kaohsiung (TW)

(73) Assignee: ALLEN PLASTIC INDUSTRIES CO., LTD., Kaohsiung (TW)

( * ) Notice: Subject to any disclaimer, the term of this patent is extended or adjusted under 35 U.S.C. 154(b) by 267 days.

(21) Appl. No.: 15/702,696

(22) Filed: Sep. 12, 2017

(65) Prior Publication Data

US 2018/0002053 A1 Jan. 4, 2018

Related U.S. Application Data

(63) Continuation-in-part of application No. 14/271,017, filed on May 6, 2014, now abandoned.

(51) Int. Cl.

| | |
|---|---|
| ***B65C 3/06*** | (2006.01) |
| ***B65C 9/04*** | (2006.01) |
| ***B65B 11/04*** | (2006.01) |

(52) U.S. Cl.

CPC ..... *B65C 3/065* (2013.01); *B65C 9/04* (2013.01); *B65B 11/045* (2013.01); *B65C 2210/0075* (2013.01)

(58) Field of Classification Search

CPC .. B65B 9/13; B65B 9/14; B65C 3/065; B65C 9/04; B65C 9/065; B65C 11/045; B65C 11/06; B29C 61/02; B29C 61/025; B29C 65/66; B29C 65/73715

USPC ..... 53/556, 585; 156/84–86

See application file for complete search history.

(56) References Cited

U.S. PATENT DOCUMENTS

| | | | | |
|---|---|---|---|---|
| 5,737,900 | A * | 4/1998 | Konstantin | B67B 5/03 53/295 |
| 6,070,399 | A * | 6/2000 | Huang | B65B 9/14 53/291 |
| 6,997,225 | B2 * | 2/2006 | Hong | B29C 63/423 156/459 |
| 7,191,574 | B2 * | 3/2007 | Malini | B65B 9/14 53/134.1 |
| 2013/0017290 | A1 * | 1/2013 | Sawamura | B65B 9/14 425/393 |
| 2013/0118120 | A1 * | 5/2013 | Heeman | B65B 11/00 53/399 |
| 2013/0118136 | A1 * | 5/2013 | Arima | B65C 3/065 53/585 |
| 2015/0203233 | A1 * | 7/2015 | Wang | B65C 3/065 53/556 |

(Continued)

FOREIGN PATENT DOCUMENTS

| | | |
|---|---|---|
| TW | 379728 | 1/2000 |

*Primary Examiner* — Hemant Desai
*Assistant Examiner* — Veronica Martin
(74) *Attorney, Agent, or Firm* — J.C. Patents

(57) ABSTRACT

A sleeve labeling machine includes a center column, a transmission device, and a cutter device. The center column can unfold the shrink film, and a transmission device will carry the shrink film and let the shrink film sleeve on the center column. Then, the cutter device will cut the shrink film, and the transmission device will keep pulling each cut shrink film to cover the surface of a bottle or a can. Finally, the transmission device will convoy bottles or cans to the next device, and let the shrink film combine with the bottle or the can to complete the bottle or can sleeve labeling process.

7 Claims, 11 Drawing Sheets

(56) References Cited

U.S. PATENT DOCUMENTS

2017/0166339 A1* 6/2017 Wang ..... B65B 53/00

* cited by examiner

SLEEVE LABELING MACHINE

CROSS-REFERENCE TO RELATED APPLICATION

This application is a continuation-in-part application of, and claims the priority benefit of, U.S. application Ser. No. 14/271,017, filed on May 6, 2014, which in turn claims the priority benefit of Taiwan application No. 103102503, filed on Jan. 23, 2014. The contents of the above-mentioned patent applications are hereby incorporated by reference in their entirety and made a part of this specification.

FIELD OF THE INVENTION

This invention is related to a sleeve labeling machine, particularly referring to a shrink film synchronous transmission device with label feeding rollers and label pulling rollers equipped between upper and lower portion of a cutter device. By label feeding rollers, the guide shrink film will be continued to guide down, and after the shrink film was cut by the cutter device, label pulling rollers will continue pulling each shrink film to cover the surface of bottles or cans, in order to prevent wrinkles produced by each shrink film to hinder conveyance and ensure the sleeve labeling machine can accurately sleeve the shrink film on cans or bottles.

DESCRIPTION OF RELATED ART

As the currently marketed sleeve labeling machine, such as the "Hot Shrink Film Guide Mechanism", a new model of publication No. 379728, mainly the feeding rollers are set surrounding at upper, middle and lower center guide column of the frame respectively; a guide roller is set at the feeding roller set corresponding to the center guide column, and a cutter device is set near the lower center guide column, and then a cutting roller is set near the lower of center guide; an adjustment roller is set at the side of feeding roller set base, between which two guide rods are set; a shaft lever is set between two guide rods; the opposite reverse threads are set at the two ends of the shaft lever, and on the opposite reverse threads, two guide blocks are set respectively; below the guide blocks, two wheel seats are fixed respectively; the wheel seat is equipment with feeding rollers, and the rear end of which is equipped with a pulley and a linkage; each feeding roller's pulley is equipped with a drive belt, and then the entire mechanism can be operated driving by a motor.

In other words, the foregoing prior art, primarily by three feeding roller sets at upper, middle and lower center guide column, guide the shrink film on the center guide column to move down; its sole purpose is to make feeding rollers of three seeding roller sets to match the diameter of center guide column so as to adjust the set position, and let the entire mechanism with the shape of cans or bottles show different setting angle, but how to conduct accurate conveyance if the thickness of shrink film subject to change is really in doubt.

To this end, the present inventor with many years of experience in the design and manufacture of related equipment, studied the structure problem especially for the foregoing prior art to carry out this invention. In addition, this invention need two guide roller sets only, placed at upper and lower cutter device respectively for synchronous operation.

SUMMARY OF THE INVENTION

The purpose of this invention is to provide a conveyance applied on the shrink film with a variety of thickness, to overcome the quality problem of shrink film, and accurately sleeve the shrink film on cans or bottles. It is an innovative sleeve labeling machine.

To achieve the foregoing object, the sleeve labeling machine of this invention includes a shrink film synchronous transmission device at center column equipped with a label feeding roller set to continuously convey the shrink film down and gradually cover the center column, and after which is cut by a cutter device, anther label pulling roller set synchronously continues pulling each shrink film down, in order to accurately cover the surface of cans or bottles.

The sleeve labeling machine of this invention is mainly centered with the center column, and the label feeding rollers and the label pulling rollers of the shrink film synchronous transmission device are set at upper and lower cutter device respectively, so that the foregoing label feeding rollers and label pulling rollers produce a synchronous feeding and pulling action against shrink film; even very thin shrink film is not difficult to produce wrinkles, each shrink film can completely cover the surface of cans or bottles.

The sleeve labeling machine of this invention is provided with a shrink film synchronous transmission device, which set with a linkage gear module and a support frame, the linkage gear module is a left and right symmetrical structure, which from top to bottom is provided with two symmetrical first rotating arms, two symmetrical second rotating arms, two symmetrical third rotating arms, two symmetrical fourth rotating arms, two symmetrical first gears, two symmetrical second gears, two symmetrical third gears, two symmetrical fourth gears and two symmetrical fifth gears. With the multi-section boom structure composed of the rotating arms 231, 232, 233, 234 and the gears 235, 236, 237, 238, 239 can increase the adjustable distance between the two feeding pulleys 20 and the two pulling pulleys 21, and in the process of adjusting the distance will not affect the synchronous rotation of the gears.

DETAILED DESCRIPTION OF THE PREFERRED EMBODIMENTS

Figure 1:
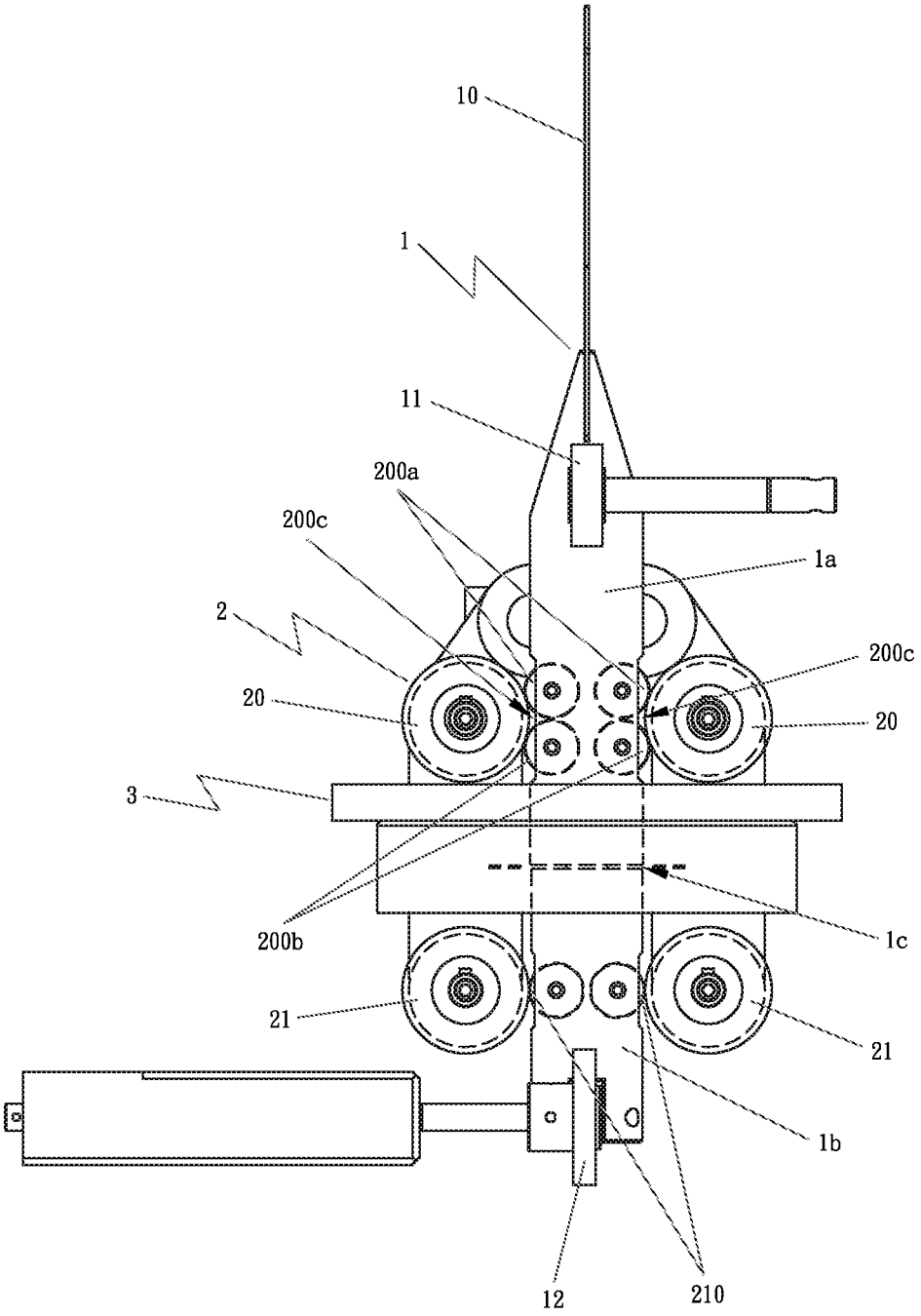
FIG. 1 is a partial front view of the first embodiment of the present invention.

Herein below preferred the sleeve labeling machine of this invention will be described in detail with reference to the accompanying drawings.

As shown in FIGS. 1 to 5, the sleeve labeling machine of this invention includes at least a center column 1, equipping with the first column 1*a* and the second column 1*b*, and a cutter trough 1*c* between the first column 1*a* and the second column 1*b*; a shrink film unfolding sheet 10 is fixed on the top of the foregoing first column 1*a*, so that the shrink film sheet A, can be unfolded via the foregoing shrink film unfolding sheet 10; the first guide pulleys 11 and the second guide pulleys 12 are set at two sides of foregoing center column 1; the foregoing first guide pulleys 11 and the second guide pulleys 12 are two sets mounted in front and rear sides of the foregoing center column 1; the most ideal is the foregoing two first guide pulleys sets 11 and the foregoing two second guide pulley sets 12 form a corresponding linear state each other. The foregoing first guide pulleys 11 are set at the first column 1*a* of the foregoing center column 1, and the foregoing second guide pulleys 12 are set at the second column 1*b* of the foregoing center column 1.

The first passive guide rollers 110 and the second passive guide rollers 120 are set within the foregoing center column 1, against the corresponding position of the foregoing first guide pulleys 11 and the second guide pulleys 12; the first passive guide rollers 110 are in contact with the foregoing first guide pulleys 11, and the foregoing second passive guide rollers 120 are in contact with the foregoing second guide pulleys 12. By label feeding rollers 20 and passive guide rollers 200, the unfolded shrink film is pulled down, along with the center column 1, to the lowest end of the center column 1, then pushing by the foregoing second guide pulleys 12 and the second passive guide rollers 120, the shrink film is completed sleeved on cans or bottles. In addition, the foregoing first guide pulleys 11 and the second guide pulleys 12, and the label feeding rollers 20 and label pulling rollers 21 of the shrink film synchronous transmission device 2 can be set at vertical position; by the foregoing first guide pulleys 11, the second guide pulleys 12, and the label feeding rollers 20 and the label pulling rollers 21 of the shrink film synchronous transmission device 2 in contract with the cross shaft plane of the shrink film, the shrink film can be guided to move down smoothly.

The foregoing first guide pulleys 11 are passive rollers, which can drive synchronously the foregoing first guide pulleys 11 to turn when the shrink film is guided down. As shown in FIGS. 4 to 7, the foregoing second guide pulleys 12 are set with two power element to drive the second guide pulleys 12 to rotate in the reverse direction. The first guide pulleys 11 and the second guide pulleys 12 are respectively provided with a first elevating device 111, a second elevating device 121, a first clamping device 112 and a second clamping device 122, so that the first guide pulleys 11 and the second guide pulleys 12 can adjust its position to match the center column 1.

The shrink film synchronous transmission device 2 is set in the middle of the foregoing center column 1, and between the foregoing first guide pulleys 11 and the second guide pulleys 12. The foregoing shrink film synchronous transmission device 2 is equipped with label feeding rollers 20 and label pulling rollers 21; there are two sets of the foregoing label feeding rollers 20 and two sets of label pulling rollers 21 mounted at right and left sides respectively of the foregoing center column 1, and the most ideal is presenting by corresponding linear state. The foregoing label feeding rollers 20 are set beside the first column 1*a* of the center column 1, at the top of the cutter device 3. And the foregoing label pulling rollers 21 are set at the side of the second column 1*b* of the center column 1, below the foregoing cutter device 3.

Figure 2:
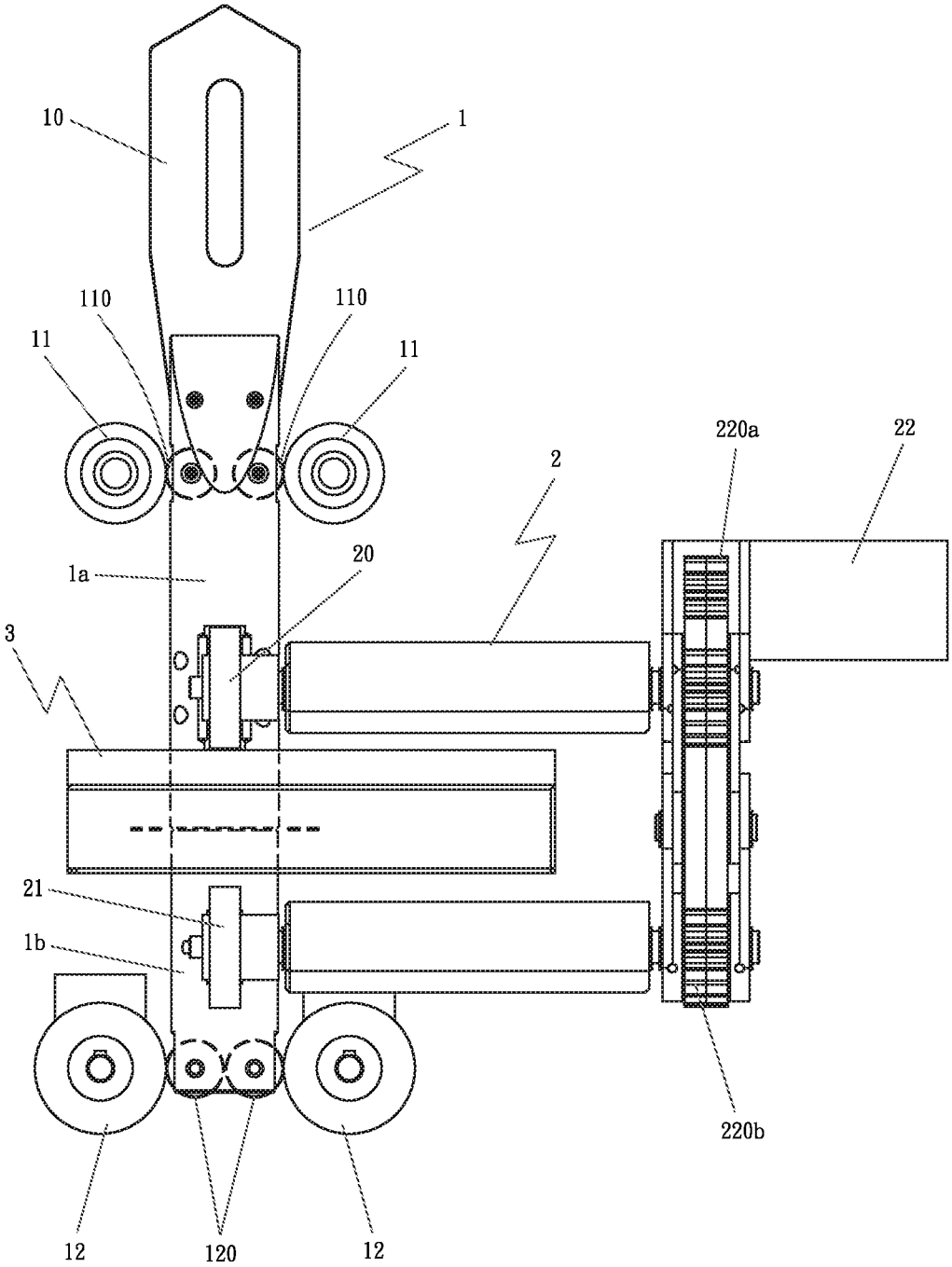
FIG. 2 is a partial side view of the first embodiment of the present invention.
Figure 3:
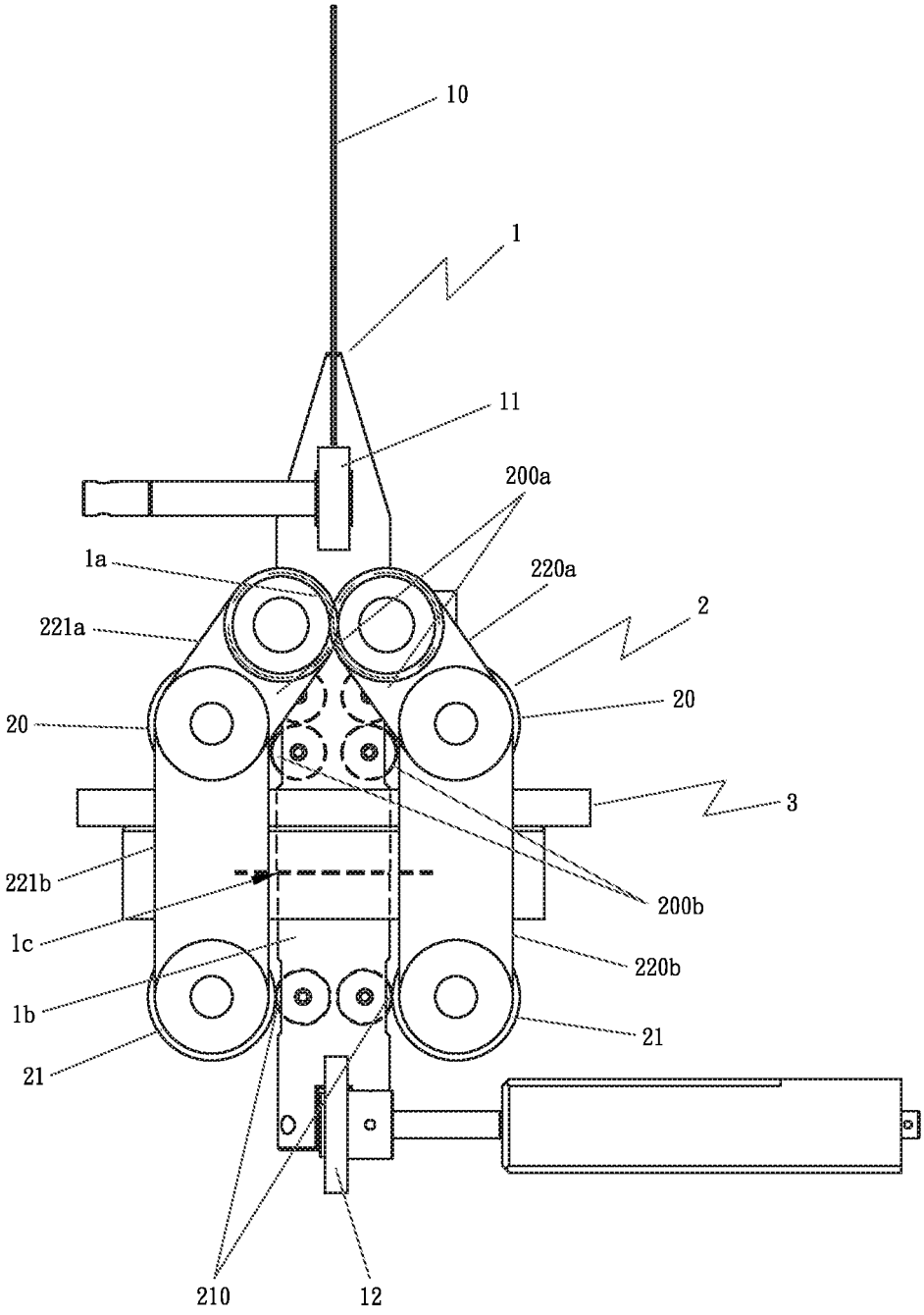
FIG. 3 is a partial rear view of the first embodiment of the present invention.
Figure 4:
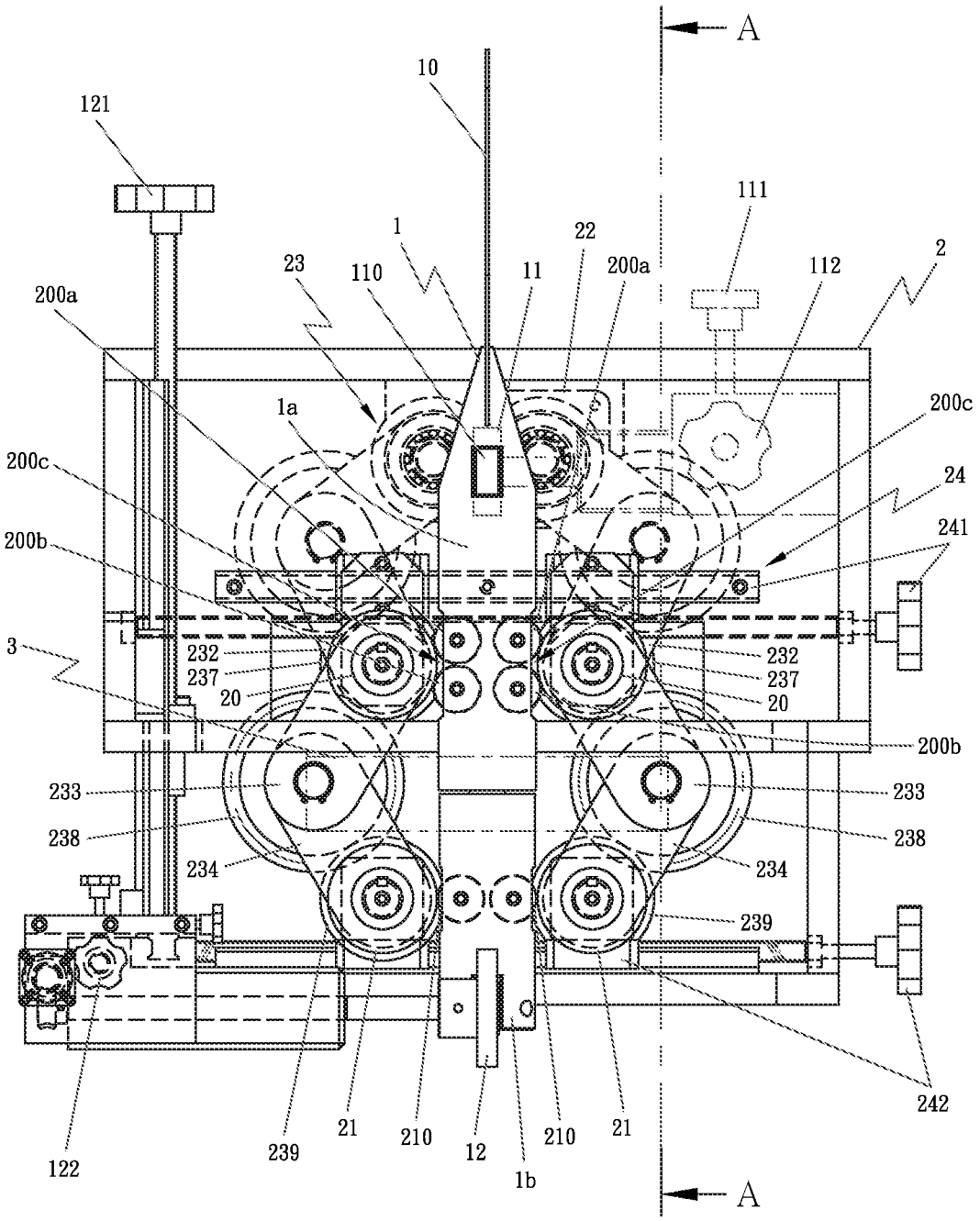
FIG. 4 is a front view of the second embodiment of the present invention.
Figure 5:
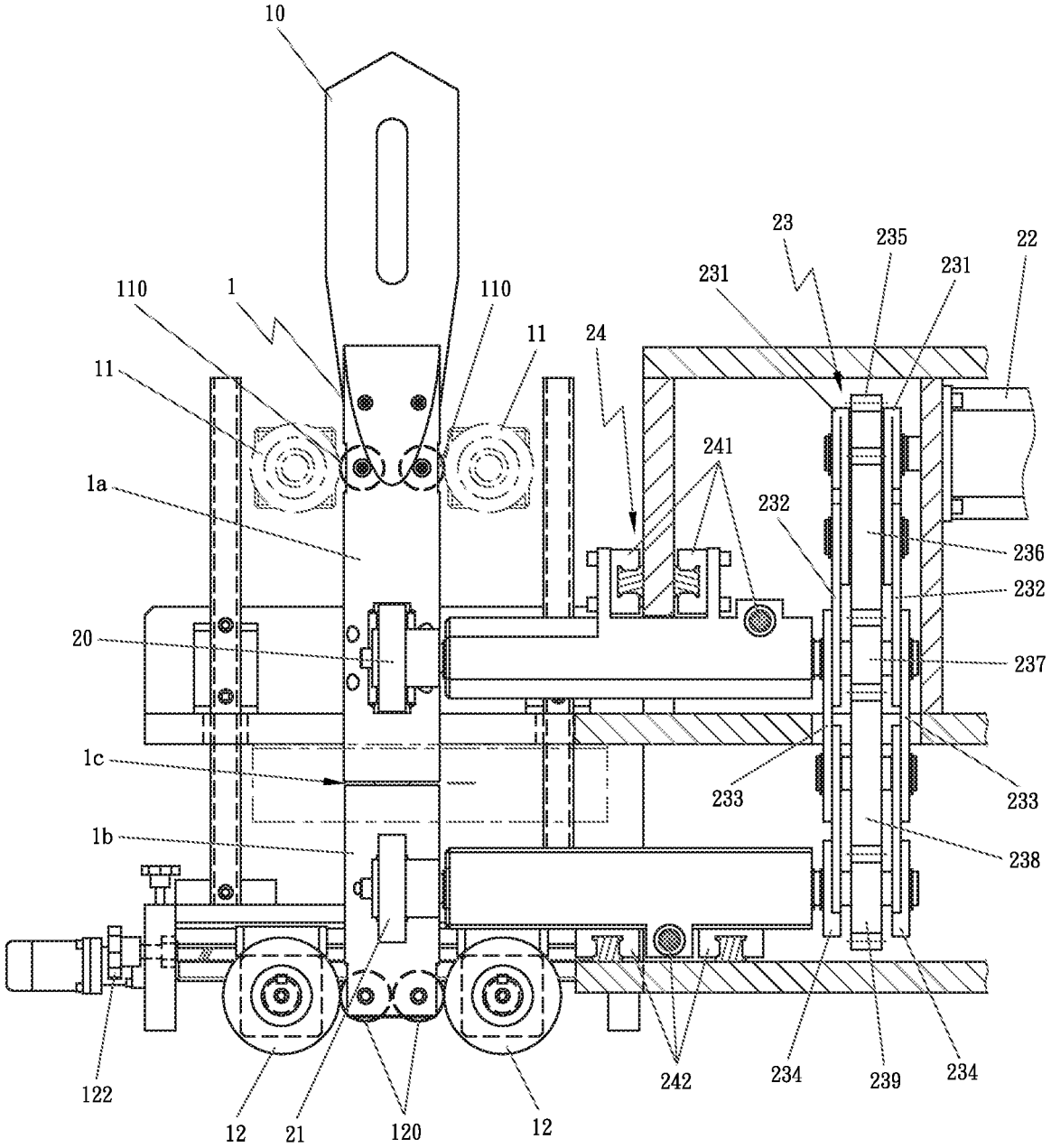
FIG. 5 is an enlarged sectional view of A-A shown in FIG. 4.
Figure 6:
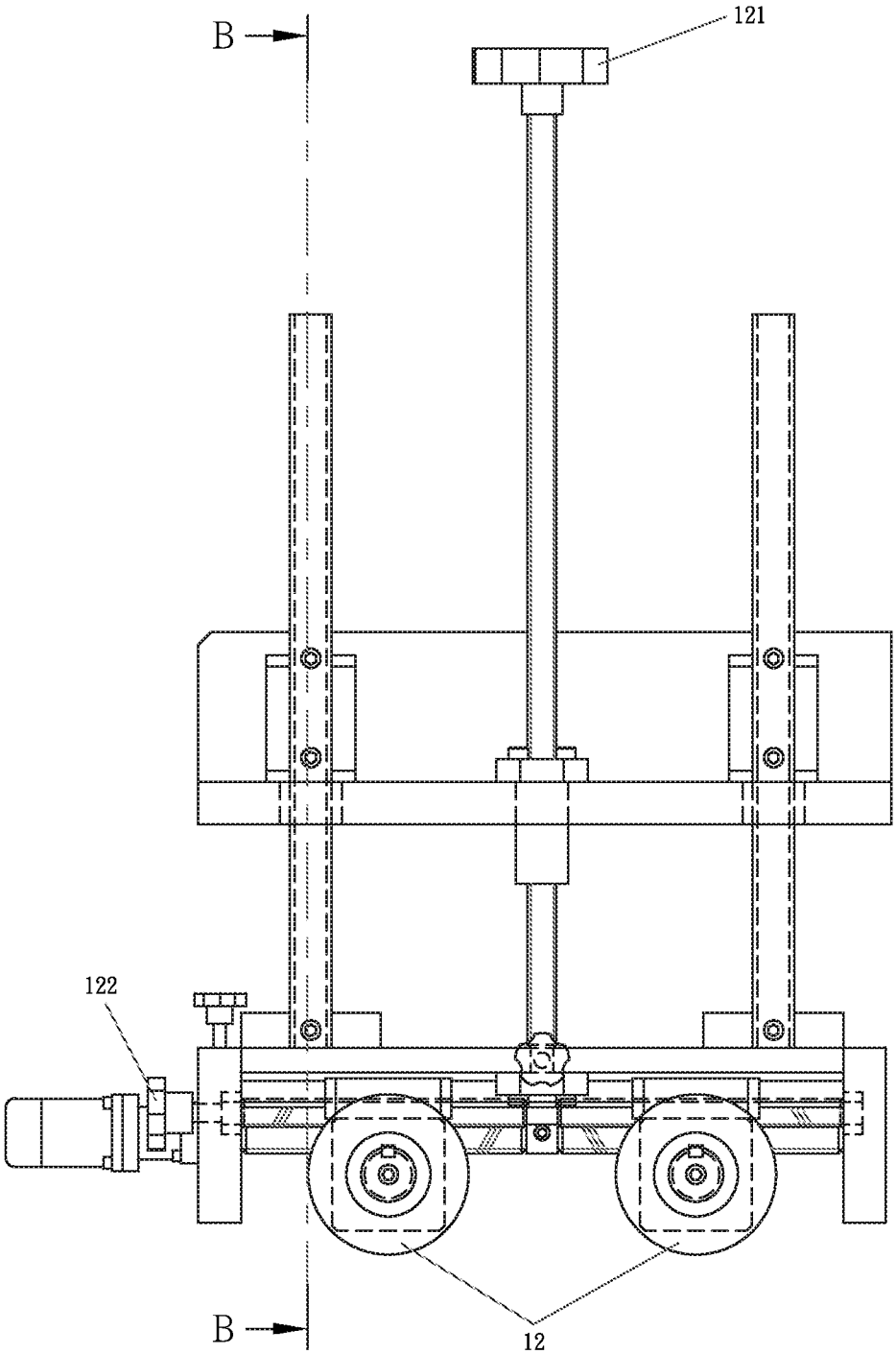
FIG. 6 is a front view of second guide pulleys of the present invention.
Figure 7:
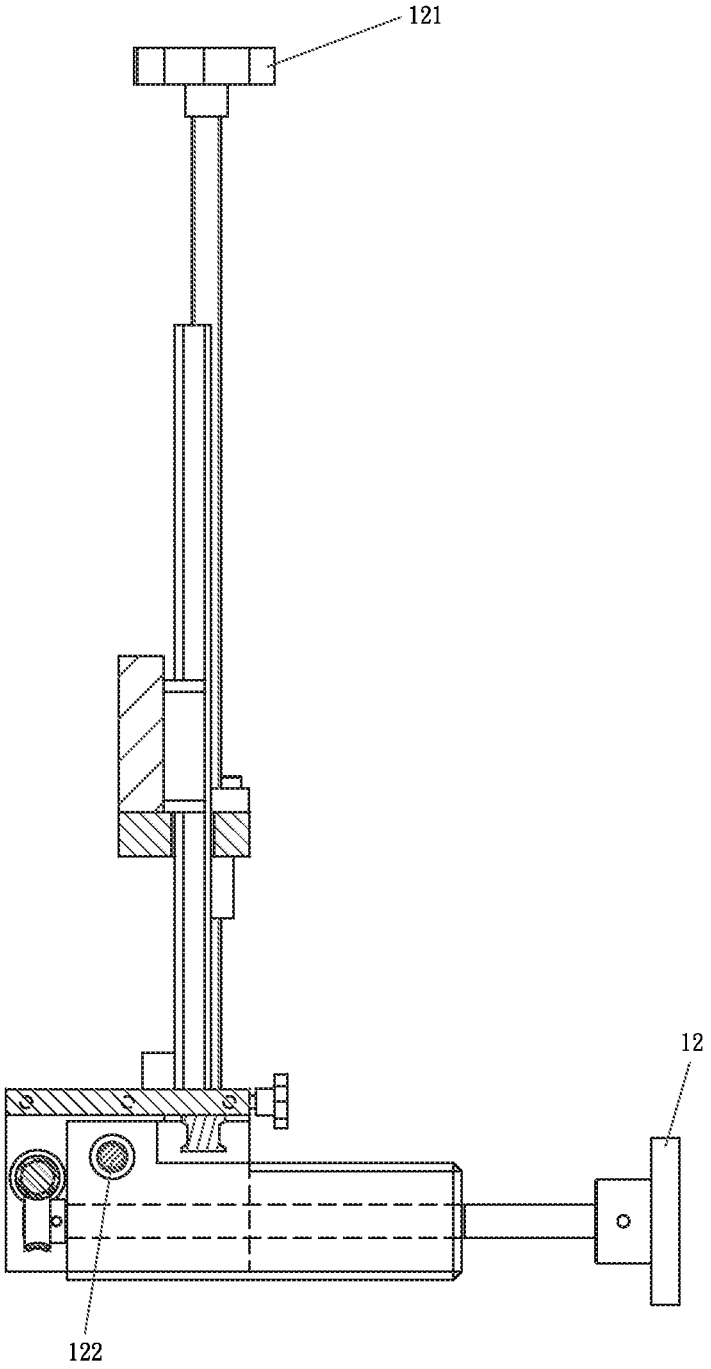
FIG. 7 is an enlarged sectional view of B-B shown in FIG. 6.

As shown in FIGS. 1 to 3, the foregoing label feeding rollers 20 and the label pulling rollers 21 using power equipment 22 to drive the mandrel, then it may be with transmission belts 220*a*, 220*b*, 221*a*, and 221*b* set around the corresponding axles, to produce the effect of synchronous transmission of label feeding rollers 20 and label pulling rollers 21, so that the foregoing label feeding rollers 20 and label pulling rollers 21 may turn synchronously, and enable the shrink film A conveyed down by foregoing label feeding rollers 20 to be successfully joined and pulled by label pulling rollers 21, so that this invention can successfully guide and convey the shrink film A with a variety of thickness.

Figure 8:
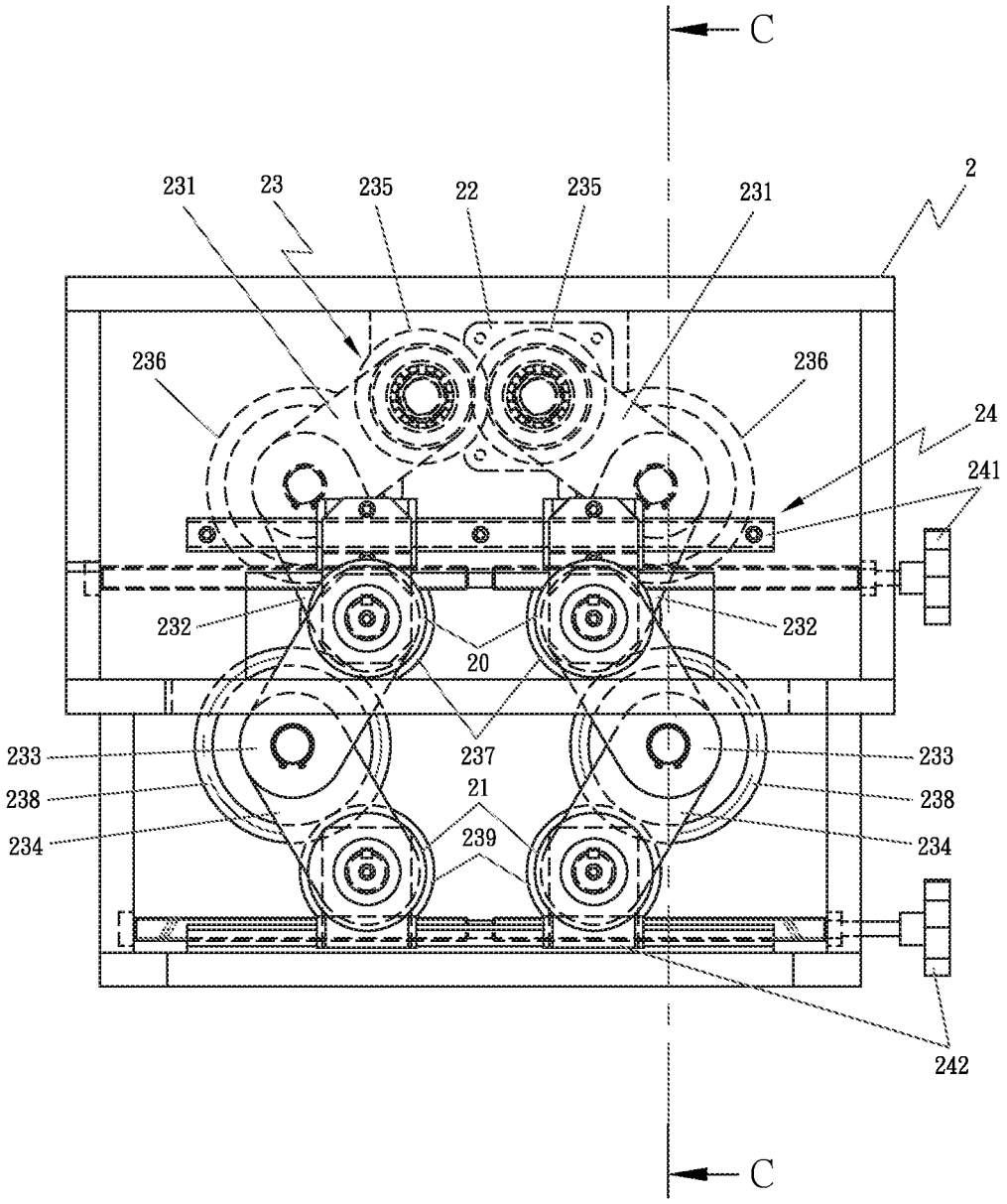
FIG. 8 is a front view of shrink film synchronous transmission device of the second embodiment of the present invention.
Figure 9:
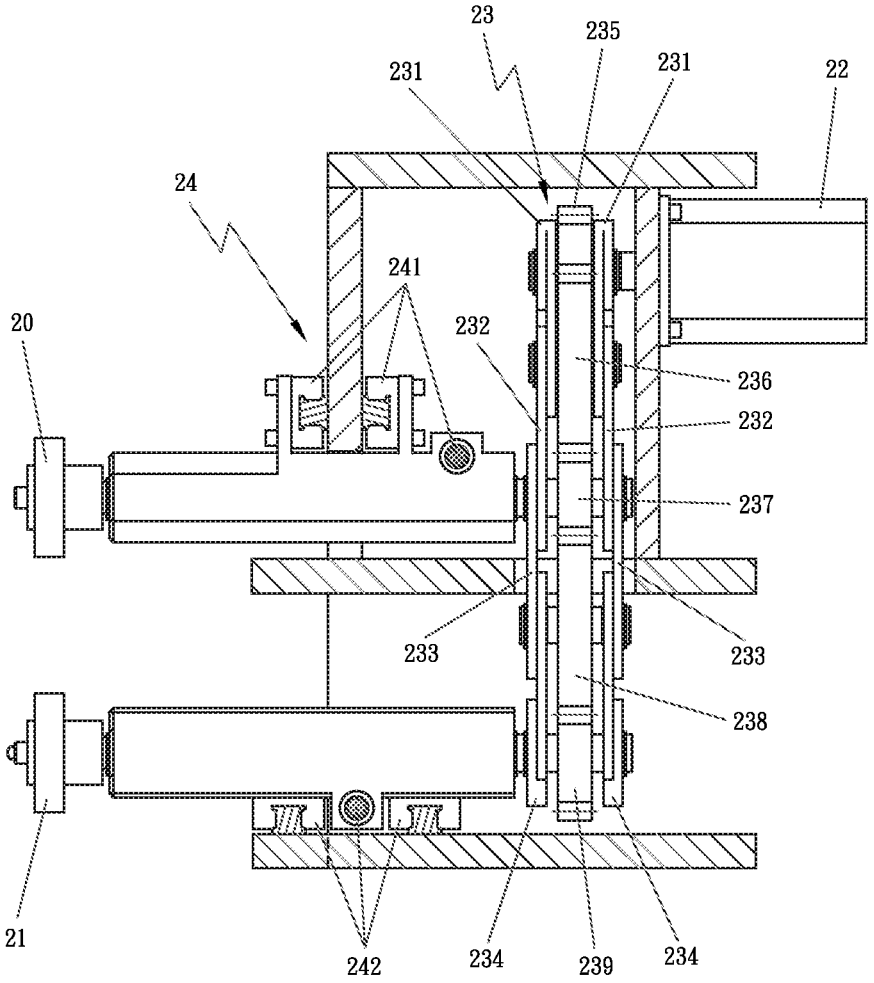
FIG. 9 is an enlarged sectional view of C-C shown in FIG. 8.
Figure 10:
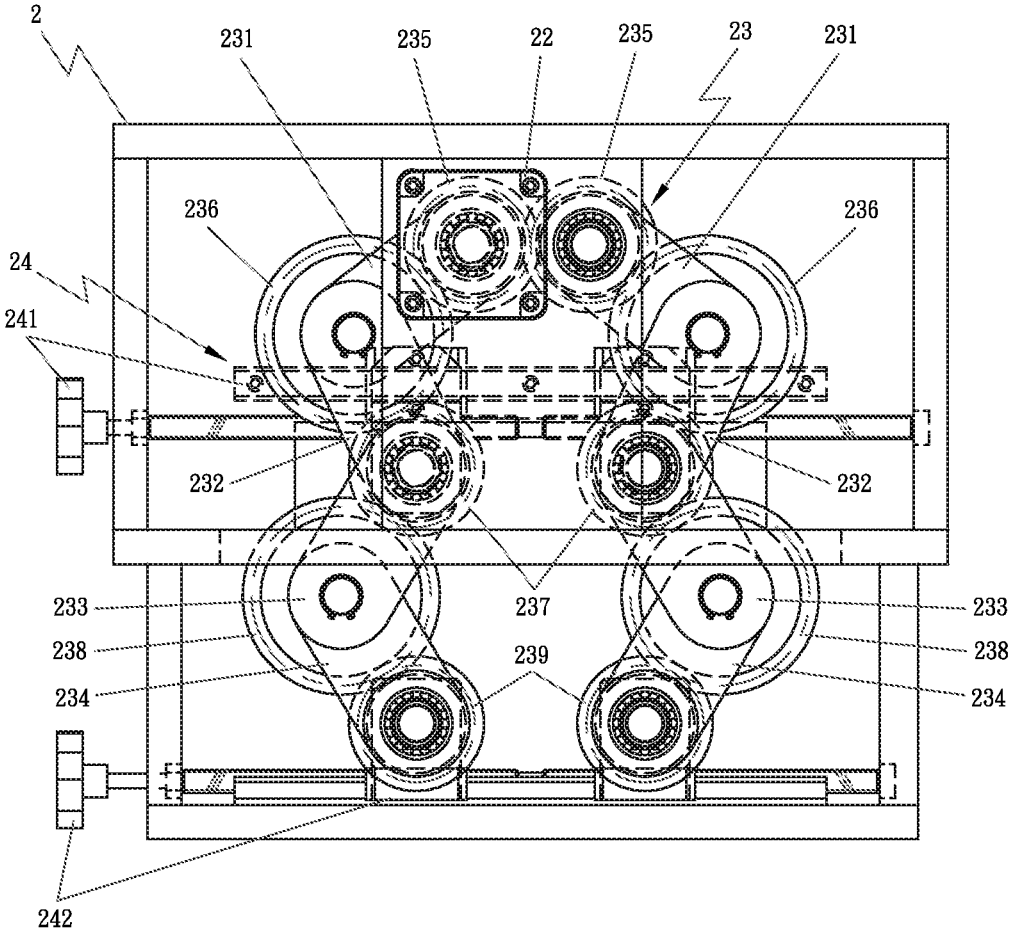
FIG. 10 is a rear view of shrink film synchronous transmission device of the second embodiment of the present invention.
Figure 11:
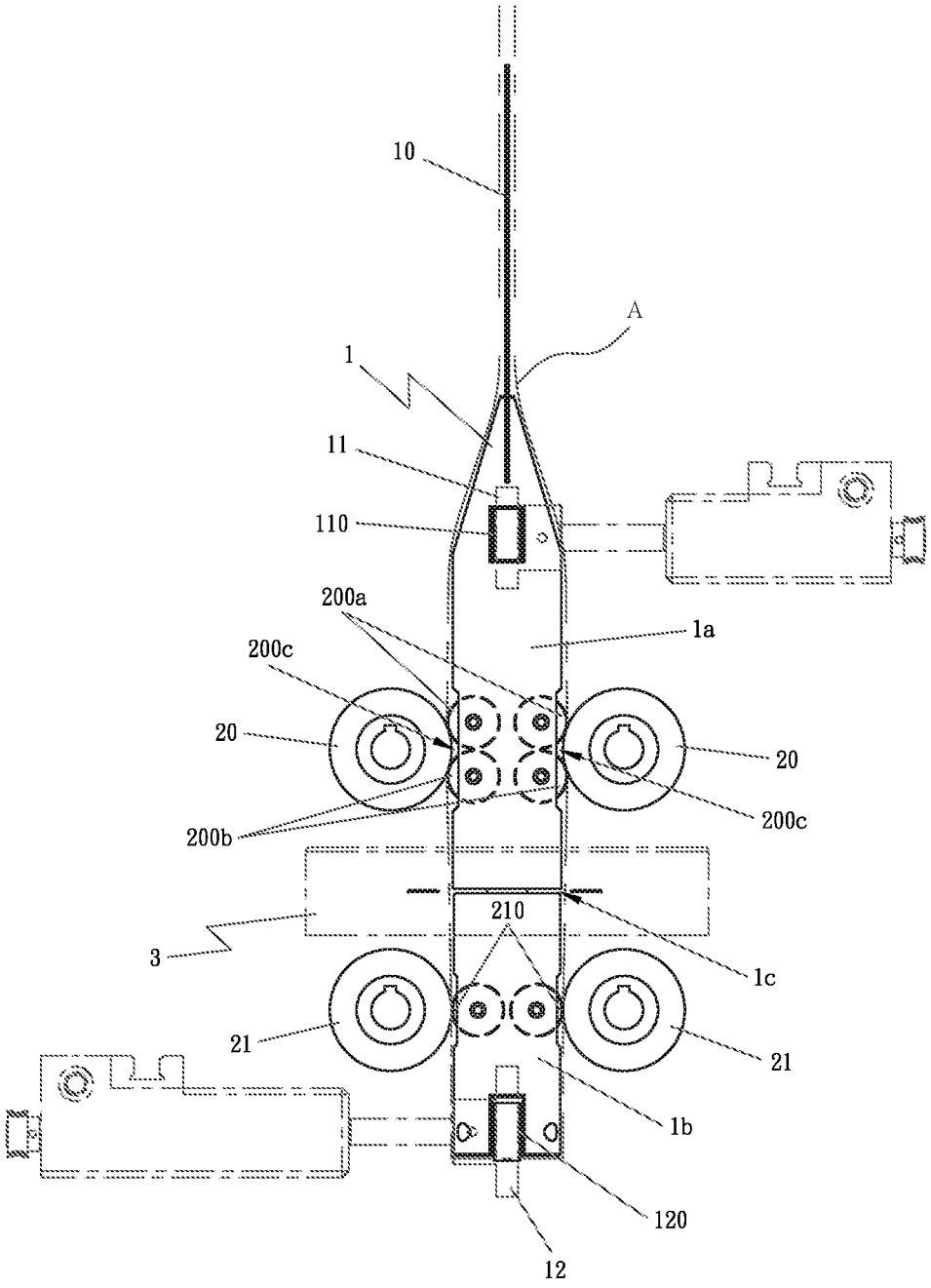
FIG. 11 is a partial operation view of the present invention.

As the transmission belts 220*a*, 220*b*, 221*a*, and 221*b* will limit the wheel to adjust the space between the two label feeding rollers 20 and the two label pulling rollers 21, and the durability of the transmission belts is poor. So, as shown in FIGS. 8 to 10, the foregoing shrink film synchronous transmission device 2 can provide a linkage gear module 23 and a support frame 24 to replace the foregoing transmission belts 220*a*, 220*b*, 221*a*, and 221*b*. The linkage gear module 23 is a left and right symmetrical structure, which from top to bottom is provided with two symmetrical first rotating arms 231, two symmetrical second rotating arms 232, two symmetrical third rotating arms 233, two symmetrical fourth rotating arms 234, two symmetrical first gears 235, two symmetrical second gears 236, two symmetrical third gears 237, two symmetrical fourth gears 238 and two symmetrical fifth gears 239.

The two first gears 235 are connected to each other and are fixed on the foregoing support frame 24, one of the first gear 235 is connected to the power equipment 22, so that the two first gears can be rotated in the opposite direction. The first gear 235 is set on the top end of the first rotating arm 231, the second gear 236 is set between the first rotating arm 231 and the second rotating arm 232, the third gear 237 is set between the second rotating arm 232 and the third rotating arm 233, the fourth gear 238 is set between the third rotating arm 233 and the fourth rotating arm 234, and the fifth gear 239 is set on the lower end of the first rotating arm 231. The third gear 237 is connected to the label feeding rollers 20 to simultaneous rotation, and the fifth gear 239 is connected to the label pulling rollers 21 to simultaneous rotation.

The foregoing support frame 24 is provided with a third clamping device 241 and a fourth clamping device 242, the third clamping device 241 is set between the support frame 24 and the label feeding rollers 20 to let the label feeding rollers 20 to be positioned steadily and allow the label feeding rollers 20 to be opened or clamped. The fourth clamping device 242 is set between the support frame 24 and the label pulling rollers 21 to let the label pulling rollers 21 to be positioned steadily and allow the label pulling rollers 21 to be opened or clamped. The foregoing third clamping device 241 and fourth clamping device 242 can be a composite structure consisting of a bi-directional thread drive rod, a slide rail and a carriage.

Therefore, with the third clamping device 241 and the fourth clamping device 242, the space between the two label feeding rollers 20 and the two label pulling rollers 21 can be adjusted precisely and hold the shrink film A. Then, the gears 235, 236, 237, 238, 239, the label feeding rollers 20 and the label pulling rollers 21 can be synchronized rotation symmetrically, when the power equipment 22 drive one of the first gear 235 to rotate, enable the shrink film A conveyed down by foregoing label feeding rollers 20 to be successfully joined and pulled by label pulling rollers 21, so that this invention can successfully guide and convey the shrink film A with a variety of thickness. In addition, the multi-section boom structure composed of the rotating arms 231, 232, 233, 234 and the gears 235, 236, 237, 238, 239 can increase the adjustable distance between the two feeding pulleys 20 and the two pulling pulleys 21, and in the process of adjusting the distance will not affect the synchronous rotation of the gears, to solve the problem of the foregoing transmission belts.

The first passive label feeding guide rollers 200*a*, the second passive label feeding guide rollers 200*b*, and the passive label pulling guide rollers 210 are set within the foregoing center column 1, against the corresponding position of the foregoing label feeding rollers 20 and label pulling rollers 21, namely, the foregoing first passive label feeding guide rollers 200*a*, and the second passive label feeding guide rollers 200*b* are set in the first column 1*a*, and the foregoing passive label pulling guide rollers 210 are set in the second column 1*b* of the center column 1; by two points of the foregoing first passive label feeding guide rollers 200*a* and the second passive label feeding guide rollers 200*b* in contact with the foregoing label feeding rollers 20, forms a triangle label feeding space 200*c*, so that the shrink film can be successfully pulled by the label feeding rollers 20, the first passive label feeding guide rollers 200*a*, and the second passive label feeding guide rollers 200*b*, and guided to convoy down by the center column 1 as axle; the foregoing passive label pulling guide rollers 210 and the foregoing label pulling rollers 21 at linear contact can continuously produce appropriate pull force to a single shrink film sheet which is convoyed by the label feeding rollers and cut by the cutter device. Thus, by the triangle label feeding space 200*c*, which is formed by two points produced by the first passive label feeding guide rollers 200*a* and the second passive label feeding guide rollers 200*b* in contact with the foregoing label feeding rollers 20, create the force to convey the shrink film down, and by the label pulling rollers 21 and passive label pulling guide rollers 210, the single shrink film sheet continuously conveyed from the foregoing label feeding rollers 20, the first passive label feeding guide rollers 200*a*, and the second passive label feeding guide rollers 200*b*, and after being cut by the cutter device is enough to prevent from wrinkles, so that the shrink film with variety of thickness can be successfully convoyed down to the lowest end of the center column 1, and then pushed by the foregoing second guide pulleys 12 and the second passive guide rollers 120, the shrink film can completely cover cans or bottles.

As shown in FIGS. 1 to 5 and 4, the cutter trough 1*c* of the foregoing center column 1 is equipped with a cutter device 3; the shrink film which has been convoyed by the foregoing label feeding rollers 20 and the passive label feeding guide rollers 200*a* and 200*b* will be cut by the foregoing cutter device 3, and then continuously pulled by the foregoing label pulling rollers 21 and passive label pulling guide rollers 210, to form a single shrink film sheet at the second column 1*b* of the foregoing center column 1, so that the shrink film with a variety of thickness can be successfully conveyed down, and pushed by the foregoing the second guide pulleys 12 and the second passive guide rollers 120, the shrink film can completely cover cans or bottles.

In summary, the sleeve labeling machine of this invention is equipped with label feeding rollers 20 and label pulling rollers 21 in the first column 1*a* and in the second column 1*b* of the center column 1 respectively, and a cutter device is set between the foregoing label feeding rollers 20 and label pulling rollers 21, in order to cut a single shrink film sheet, and the label pulling rollers continue to pull the single shrink film sheet down. Moreover, with the innovative linkage gear module 23 and a support frame 24, the multi-section boom structure composed of the rotating arms 231, 232, 233, 234 and the gears 235, 236, 237, 238, 239 can increase the adjustable distance between the two feeding pulleys 20 and the two pulling pulleys 21, and in the process of adjusting the distance will not affect the synchronous rotation of the gears, with the best stability and functionality. Hence, this invention can operate matching shrink film with a variety of thickness, in order to prevent each shrink film cut producing the wrinkles hindering conveyance and ensure the sleeve labeling machine enables the shrink film to accurately cover cans or bottles. These are advanced components of this invention.

DESCRIPTION OF SYMBOLS

A center column 1, the first column 1*a*, the second column 1*b*, a cutter trough 1*c*, a shrink film unfolding sheet 10, the first guide pulleys 11, the second guide pulleys 12, the first passive guide rollers 110, the second passive guide rollers 120, a shrink film A, first elevating device 111, second elevating device 121, first clamping device 112, second clamping device 122

A shrink film synchronous transmission device 2, label feeding rollers 20, label pulling rollers 21, power equipment 22, transmission belts 220*a*, 220*b*, 221*a*, 221*b*, the first passive label feeding guide rollers 200*a*, the second passive label feeding guide rollers 200*b*, passive label pulling guide rollers 210, triangle label feeding space 200*c*, linkage gear module 23, first rotating arms 231, second rotating arms 232, third rotating arms 233, fourth rotating arms 234, first gears 235, second gears 236, third gears 237, fourth gears 238 and fifth gears 239, support frame 24, third clamping device 241, fourth clamping device 242, cutter device 3.

What is claims is:

1. A sleeve labeling machine comprising at least a shrink film synchronous transmission device equipped with label feeding rollers and label pulling rollers, which can produce a synchronous guide and conveyance by feeding and pulling action against a shrink film on a center column; wherein the center column includes a first column and a second column aligned with the first column and cutter through is formed between the first column and the second column, said label feeding rollers are set at the side of the first column of the center column, and at the top of a cutter device; said label pulling rollers are set at the side of the second column of the center column, and below said cutter device; said label feeding rollers can convey the shrink film on the center column down, and after the label pulling rollers pulling synchronously, said shrink film can be cut by the cutter device, forming a single shrink film sheet at the second column of said center column, and then said label pulling rollers synchronously continue pulling each shrink film down, so that the shrink film can accurately cover a surface of cans or bottles as a shrink packaging;

wherein said shrink film synchronous transmission device is provided with a linkage gear module and a support frame, the linkage gear module is of a left and right symmetrical structure, which from top to bottom is provided with two symmetrical first rotating arms, two symmetrical second rotating arms, two symmetrical third rotating arms, two symmetrical fourth rotating arms, two symmetrical first gears, two symmetrical second gears, two symmetrical third gears, two symmetrical fourth gears and two symmetrical fifth gears; wherein said two first gears are connected to each other and are fixed on said support frame, one of the first gear is connected to a power equipment, so that the two first gears can be rotated in opposite direction; the two first gears are set on a top end of the two first rotating arms respectively, the two second gears are set between the two first rotating arms and the two second rotating arms respectively, the two third gears are set between the two second rotating arms and the two third rotating arms, the two fourth gears are set between the two third rotating arms and the two fourth rotating arms, and the two fifth gears are set on a lower end of the two first rotating arms respectively; the two third gears are connected to the label feeding rollers to simultaneous rotation, and the two fifth gears are connected to the label pulling rollers to simultaneous rotation.

2. The sleeve labeling machine of claim 1, wherein first guide pulleys and second guide pulleys are set at two sides of the center column respectively; said first guide pulleys and the second guide pulleys are two sets mounted in front and rear sides of said center column respectively; said first guide pulleys are set in the first column of the center column, and said second guide pulleys are set in the second column of the center column; said second guide pulleys are equipped with axles as power elements for drive; first passive guide rollers and second passive guide rollers are set within said center column, against a corresponding position of said first guide pulleys and the second guide pulleys; said first passive guide rollers are in contact with said first guide pulleys, and said second passive guide rollers are in contact with said second guide pulleys to form an appropriate force pulling a shrink film.

3. The sleeve labeling machine of claim 2, wherein the first guide pulleys and the second guide pulleys, and the label feeding rollers of the shrink film synchronous transmission device are set at vertical position; by said first guide pulleys, the second guide pulleys, and the label feeding rollers and the label pulling rollers of the shrink film synchronous transmission device in contact with a cross shaft plane of a shrink film, can successfully guide to move the shrink film down.

4. The sleeve labeling machine of claim 1, wherein two sets of the label feeding rollers and two sets of the label pulling rollers of the film synchronous transmission device are mounted at right and left sides of the center column respectively and form a corresponding linear state.

5. The sleeve labeling machine of claim 4, wherein first passive label feeding guide rollers, second passive label feeding guide rollers, and passive label pulling guide rollers are set within the center column, against a corresponding position of the label feeding rollers and the label pulling rollers; said first passive label feeding guide rollers, and the second passive label feeding guide rollers are set in the first column, and said passive label pulling guide rollers are set in the second column of the center column; by two points of said first passive label feeding guide roller and the second passive label feeding guide rollers in contact with the label feeding roller, forms a triangle label feeding space, so that a shrink film can be successfully pulled by the label feeding rollers, the first passive label feeding guide rollers, and the second passive label feeding guide rollers, and guided to convoy down by the center column as axle; said passive label pulling guide rollers and said label pulling rollers at linear contact can continue producing appropriate pull force to a single shrink film sheet which is convoyed by the label feeding rollers and cut by the cutter device.

6. The sleeve labeling machine of claim 1, wherein said support frame is provided with a third clamping device and a fourth clamping device, the third clamping device is set between the support frame and the label feeding rollers to let the label feeding rollers to be positioned steadily and allow the label feeding rollers to be opened or clamped; the fourth clamping device is set between the support frame and the label pulling rollers to let the label pulling rollers to be positioned steadily and allow the label pulling rollers to be opened or clamped.

7. The sleeve labeling machine of claim 6, wherein said third clamping device and fourth clamping device are of a composite structure consisting of a bi-directional thread drive rod, a slide rail and a carriage.

* * * * *